US009689177B2

(12) United States Patent
Langenwalter et al.

(10) Patent No.: US 9,689,177 B2
(45) Date of Patent: Jun. 27, 2017

(54) RACKABLE FENCING OF COMPONENTS OPTIMIZED FOR PREASSEMBLY SHIPPING

(71) Applicant: ORIGIN POINT BRANDS, LLC, North Charleston, SC (US)

(72) Inventors: Duane E Langenwalter, Monroe, CT (US); Ning Xue, Danbury, CT (US)

(73) Assignee: Origin Point Brands, LLC, North Charleston, SC (US)

( * ) Notice: Subject to any disclaimer, the term of this patent is extended or adjusted under 35 U.S.C. 154(b) by 395 days.

(21) Appl. No.: 14/457,230

(22) Filed: Aug. 12, 2014

(65) Prior Publication Data

US 2014/0346422 A1 Nov. 27, 2014

Related U.S. Application Data

(63) Continuation of application No. 13/351,927, filed on Jan. 17, 2012, now Pat. No. 8,833,737.

(51) Int. Cl.
*E04H 17/14* (2006.01)

(52) U.S. Cl.
CPC ..... *E04H 17/1426* (2013.01)

(58) Field of Classification Search
CPC . E04F 11/181; E04F 11/1821; E04F 11/1834; E04F 11/1817; E04F 11/1836; E04H 17/1439; E04H 17/1443; E04H 17/1434; E04H 17/1447; E04H 2017/1491
See application file for complete search history.

(56) References Cited

U.S. PATENT DOCUMENTS

| | | | | |
|---|---|---|---|---|
| 5,155,963 | A * | 10/1992 | Woodman | A47G 5/00 160/351 |
| 5,660,378 | A * | 8/1997 | Schall | E04H 17/1439 256/22 |
| 6,375,166 | B1 | 4/2002 | Schall et al. | |
| 6,631,887 | B1 * | 10/2003 | Walmsley | E04H 17/1439 256/22 |
| 6,752,385 | B2 | 6/2004 | Zen et al. | |
| 6,752,386 | B1 * | 6/2004 | Bundy | E04H 17/1439 256/22 |
| 7,384,025 | B2 | 6/2008 | Lo | |
| 2006/0081828 | A1 | 4/2006 | Gidseg | |
| 2008/0121857 | A1 * | 5/2008 | Lo | E04H 17/1417 256/65.01 |
| 2009/0065755 | A1 * | 3/2009 | Sherstad | E01F 13/022 256/22 |
| 2010/0044662 | A1 * | 2/2010 | Walmsley | E04H 17/1439 256/24 |

(Continued)

FOREIGN PATENT DOCUMENTS

| | | | |
|---|---|---|---|
| EP | 1234933 | A1 | 8/2002 |
| EP | 2007119039 | A1 | 10/2007 |

(Continued)

*Primary Examiner* — Daniel Wiley
(74) *Attorney, Agent, or Firm* — Timothy D. St. Clair; Nexsen Pruet, LLC

(57) ABSTRACT

A rackable fence is provided with a rail, picket carrier, and plurality of pickets. The rail defines a rigid inverted U-shaped cross-section. The picket carrier includes a top span residing within and extending across the interior of the rail. The pickets are pivotally attached to the picket carrier and pivotable toward the rail.

10 Claims, 12 Drawing Sheets

(56) References Cited

U.S. PATENT DOCUMENTS

| | | | | |
|---|---|---|---|---|
| 2010/0237308 | A1* | 9/2010 | Lo | E04H 17/1417<br>256/26 |
| 2011/0001105 | A1* | 1/2011 | Lo | E04H 17/1443<br>256/65.08 |
| 2011/0042637 | A1* | 2/2011 | Howard | E04H 17/1439<br>256/22 |
| 2011/0233499 | A1* | 9/2011 | Stinson | E04H 17/143<br>256/65.01 |

FOREIGN PATENT DOCUMENTS

| | | | | |
|---|---|---|---|---|
| GB | 2393741 A | * | 4/2004 | E04H 17/1439 |
| GB | 2435055 A | | 8/2007 | |

* cited by examiner

RACKABLE FENCING OF COMPONENTS OPTIMIZED FOR PREASSEMBLY SHIPPING

This application is a continuation of application Ser. No. 13/351,927, filed on Jan. 17, 2012, which is currently pending, the contents of which are incorporated herein by reference.

TECHNICAL FIELD

The present invention relates generally to rackable fencing and, more particularly, to rackable fencing comprising components that have been optimized for shipping unassembled from a manufacturing location to an assembly location.

BACKGROUND

Good fences make good neighbors. Better fences, however, should achieve more.

The terrain across which a fence may be desired often is not level but rather is inclined. Accounting for such topography may require expensive and time consuming custom fence fabrication on-site. It is more desirable, however, for fencing for such a project to be purchased pre-assembled, yet adaptable for adjustment to match inclined terrain, as pre-assembly would simplify installation and would reduce costs as a result of economies of scale. Even more desirably, such pre-assembled fencing might be adjustable to match a range of inclines, as a range of inclines may be encountered even upon a single fencing installation and certainly between several fencing sites.

Modularity of pre-assembled fencing panels is also desirable. Inasmuch as plans may be altered during installation of fencing, or additional fencing may be discovered to be desirable after installation of an initial run, or later replacement may be desired of a section of fencing damaged after installation, modularity of design would allow easy and aesthetically matching and consistent final results.

The modern economy is described as "global" and in such a context it would be desirable to provide a fence design with components that may be manufactured at a first location, better suited for manufacturing, and shipped unassembled to a second location, better suited for assembly, at which second location the components should be of a design that they are easily connected into finished fencing panels for sale thereafter to end users or for distribution to retailers. In such a context, recognizing the need to minimize the shipping costs, it would be desirable for a fencing design to comprise a minimal number of components that had been optimized so as to be most densely packed into shipping containers. Ideally, those same components should at the same time be of a design allowing efficient connectivity at the assembly location, preferably requiring use only of simple and inexpensive tools, and, once assembled, complement the structural function of each other.

For fencing that is to be manufactured at a first location and shipped unassembled to a second location for assembly, it would be desirable for the components to be designed such that they could be fully painted, coated, or otherwise surface-treated at the manufacturing site yet later assembled at a possibly distant assembly site without damage to the finished surface from transport or from assembly. As to shipping, such fencing components should have no exposed and/or delicate features that would be susceptible to damage in transit, which is inefficient and costly to repair distant from a manufacturing location. Once delivered to the assembly location for assembly, such fencing should comprise a minimal number of different components, for simplification of assembly. And, ideally, only simple, inexpensive tools would be required for such assembly. Once assembled and ready for sale to end users, connectors and structural details ought to be concealed from view, for aesthetic appeal.

Finally, for fencing designed to be manufactured at a first location and shipped unassembled for assembly at a second location into finished fencing product, it would be desirable for the design of the fencing components and the finished assembly to be such that the finished assembly is sturdy, structurally sound, tight, and without loose parts.

The fencing products previously known do not ideally address the foregoing objectives.

SUMMARY OF THE INVENTION

A rackable fencing comprising components that have been optimized for pre-assembly shipping is disclosed. As revealed in the following description and the appended figures, this invention discovers a clever and efficient design that achieves the described objectives and more.

In accordance with certain aspects of certain embodiments of the present technology, a rackable fence is provided that comprises a rail, a picket carrier, and a plurality of pickets. The rail may define a rigid inverted U-shaped cross-section and a longitudinal axis. The picket carrier may include a top span that resides within and extends across the inverted U-shaped cross-section. Each of the pickets may be pivotally attached to the picket carrier and pivotable toward the rail.

First and second shoulders may be disposed within the bottom of the inverted U-shaped cross-section and located opposite one another. The picket carrier may reside above the first and second shoulders. In certain embodiments, each pivotal attachment of each picket to a picket carrier may be at a screw, a bolt, a pin, a rivet, or a spring-loaded keeper.

The picket carriers may be metal, extruded plastic, or injection molded plastic.

In certain embodiments, the inverted U-shaped cross-section may be symmetrical.

In some configurations, the rail, the first shoulder, and the second shoulder may be integral.

In accordance with yet additional aspects of other embodiments of the present technology, a rackable fence is provided that may include a first and second rail, a first and second picket carrier, and a plurality of pickets. The first and second rail may each have a header, a first wall extending downwardly from one side of the header, and a second wall extending downwardly from the other side of the header. The header, first wall, and second wall may be rigid one-to-another. The first wall may carry a first shoulder that is disposed toward the second wall and the second wall may carry a second shoulder that is disposed toward the first wall, with both the first and second shoulders disposed opposite the header. The first and second picket carriers may each include a plurality of apertures defined top-to-bottom through each such carrier, with a span across the top of each carrier between such apertures. The first and second picket carriers may be carried upon and above the first and second shoulders that may be, in turn, carried by the first and second walls, respectively. Each picket may be attached to the first and second picket carriers at the apertures and configured to be pivotable toward the first rail.

In certain embodiments, the header, and the first and second shoulders may be integral. In particular configurations, the header, first and second walls, and first and second shoulders may be roll formed and, in some instances, roll formed from a single width of material.

The first and second shoulders may define between them a first width and the first and second picket carriers may each define a cross-sectional width, such cross-sectional width being greater than the defined first width. In particular configurations of the present technology, the first and second rails may define a first symmetrical cross-section. In some aspects, the first and second picket carriers may each define a second symmetrical cross-section.

In accordance with aspects of other embodiments of the present technology, a rackable fence may be provided with a first and second rail, first and second picket carriers, and a plurality of pickets. The first and second rails may each define a length and have a header, a first wall that depends downwardly from the header, and a second wall that depends downwardly from the first header and that is opposite the first wall. The header may be disposed above the first and second walls and, together with the first wall and second wall, define a channel between them. The first and second picket carriers may each be in contact with a first and second wall of a respective rail. Further, each such picket carrier may define a cross-section, the cross-section being open downwardly. Each such picket carrier may carry a plurality of pivots, the pivots being disposed normal to the length defined by the rails at the location of each such pivot. The first and second picket carriers and the pivots may reside within a channel of one of the rails. Each of the pickets may be attached to the first and the second picket carriers by the pivots. The first rail may be movable along its length relative to the second rail.

In accordance some embodiments of the present technology, the header, the first wall, and the second wall may be rigid relative to each other. In particular configurations, the first wall may carry a first shoulder that is opposite the header and the second wall may carry a second shoulder that is opposite the header, with the first picket carrier being carried by the first and second shoulders.

In accordance with yet still further aspects of other embodiments of the present technology, the first and second picket carriers may each include a top span, a first and second profile that both extend downwardly from the top span, a first flange extending outwardly from the first profile, and a second flange extending outwardly from the second profile. In some arrangements, the first flange may be carried upon the first shoulder of the first wall of a rail and the second flange may be carried upon the second shoulder of the second wall.

In accordance with yet still further aspects of other embodiments of the present technology, the top span, first profile, second profile, first flange, and second flange may be integral.

In certain embodiments, the first and second picket carriers may each define symmetrical cross-sections. Also, the header, the first wall, and the second wall may be integral.

So configured, a fence is disclosed with components that may be manufactured at a first location and shipped unassembled to a second location for assembling. A minimal number of different components are required. The components may be fully painted, coated, or otherwise surface-treated at the manufacturing site yet later assembled at a second site without damage to the finished surface from transport or from assembly, as they have no exposed or delicate features that are susceptible to damage in transit. The components may be densely packed into shipping containers, yet thereafter easily connected into finished fencing panels with efficient connectivity requiring use only of simple and inexpensive tools. Once assembled and ready for sale to end users, the fence's components complement the structural function of each other and the finished assembly is sturdy, structurally sound, tight, and without loose parts, and connectors and structural details are concealed from view.

The foregoing description sets forth broadly certain features of the present technology so that the detailed description herein below may be better understood and so that the present contributions to the art from this invention may be better appreciated. Additional features of the invention may be described below.

Additional objects and advantages of the present subject matter are set forth in, or will be apparent to those of ordinary skill in the art from, the detailed description herein. Also, it should be further appreciated that modifications and variations to the specifically illustrated and/or discussed features and elements of this technology may be practiced in various embodiments and uses of the invention without departing from the spirit and scope of the subject matter. Variations may include, but are not limited to, substitution of equivalent means, features, or steps for those illustrated, referenced, or discussed, and the functional, operational, or positional reversal of various parts, features, steps, and the like. Still further, it is to be understood that different embodiments, as well as different presently preferred embodiments, of the present subject matter may include various combinations or configurations of the presently disclosed features, steps, or elements, or their equivalents (including combinations of features, parts, or steps or configurations thereof not expressly shown in the figures or stated in the detailed description of such figures). Additional embodiments of the present subject matter, not necessarily expressed in the summarized section, may include and incorporate various combinations of aspects of features, components, or steps referenced in the summarized objects above, and/or other features, components, or steps as otherwise discussed in this application. Those of ordinary skill in the art will better appreciate the features and aspects of such embodiments, and others, upon review of the remainder of this specification.

BRIEF DESCRIPTION OF THE DRAWINGS

The details of the present invention, both as to its structure and its functionality, can be understood with reference to the accompanying figures. It should be noted that these figures are not necessarily to scale in all instances.

DETAILED DESCRIPTION

Figure 1:
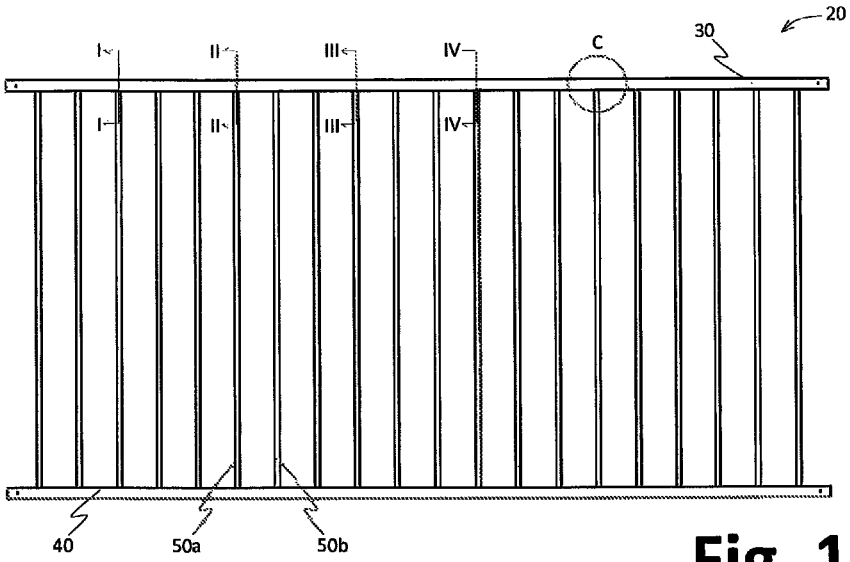
FIG. 1 is a side elevation view of rackable fencing in accordance with certain aspects of the present invention.

Reference will now be made in detail to presently preferred embodiments of the invention, one or more examples of which are illustrated in the figures. Each example is provided by way of explanation of the technology and is not meant to be a limitation of the invention. For example, features illustrated or described as part of one embodiment may be used with a different embodiment to yield yet still another embodiment. It is intended that the present application includes such modifications and variations as come within the scope and spirit of the invention. Selected combinations or aspects of the disclosed technology correspond to a plurality of different embodiments of the present invention. Certain features may be interchanged with similar devices or different features not expressly mentioned that perform the same or similar functions.

As used herein, the singular forms of "a," "and," and "the," include plural referents unless the context clearly dictates otherwise.

The present invention of a rackable fencing of components optimized for pre-assembly shipping includes a fence generally 20. The fence 20 may comprise a first rail 30 and a second rail 40, picket carriers 60*a,b*, and pickets 50*a,b*.

Each rail 30, 40 may define a length. Furthermore, first rail 30 and second rail 40 may have identical cross-sections and be otherwise identical except second rail 40 may have apertures disposed along its first header 31 and configured for receipt therethrough of pickets, such as pickets 50*a,b*.

A rail, such as first rail 30, may be configured with a first wall 32 extending downwardly from a first side of a first header 31, and a second wall 33 extending downwardly from a second side of first header 31, with second wall 33 disposed opposite first wall 32. In certain embodiments, a rail such as first rail 30 may define an inverted U-shaped cross-section. In particular embodiments, the cross-section of a rail, such as first rail 30, may be symmetrical. The cross-section of a rail, such as first rail 30, may define a channel within its inverted U-shaped cross-section. In certain particular respects, the cross-sectional configuration of a rail, such as first rail 30, may be rigid.

First shoulder 36 and second shoulder 37 may be disposed upon a rail, such as first rail 30 or second rail 40. First shoulder 36 and second shoulder 37 may reside at the bottom of the inverted U-shaped cross-section of a rail, such as first rail 30 or second rail 40, opposite one another and disposed toward one another. First shoulder 36, and second shoulder 37 may be integral with first wall 32 and second wall 33, respectively. In certain embodiments, first header 31, first wall 32, second wall 33, first shoulder 36 and second shoulder 37 may all be integral one-with-another. Particularly, for certain applications, a first rail 30 may be roll formed to include a first header 31, a first wall 32, a second wall 33, a first shoulder 36, and a second shoulder 37.

Figure 2:
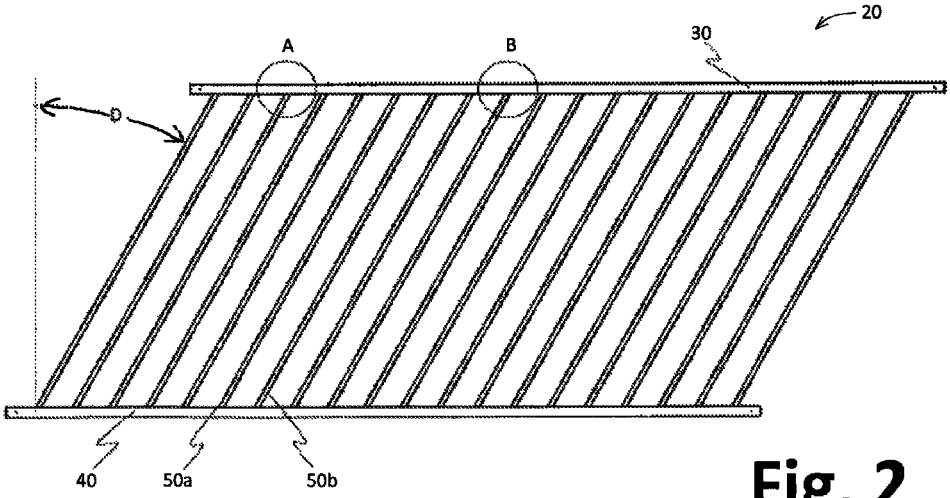
FIG. 2 is a side elevation view of rackable fencing in accordance with certain aspects of the present invention.

As will be further appreciated from other aspects of the disclosure herein, first rail 30 is movable along its length relative to second rail 40, as depicted, for example, in FIG. 2.

One or more picket carriers 60 are also provided with fence 20. Picket carrier 60 may be metal, extruded plastic, injection molded plastic, or other suitable structural material.

A picket carrier 60 may be disposed and reside within the channel formed by a rail 30, 40. In certain embodiments, a picket carrier 60 may reside above shoulders 36, 37 that are disposed within a rail 30. In particular embodiments, a picket carrier 60 may be carried upon first shoulder 36 and second shoulder 37.

In cross-section, picket carrier 60 may include a top span 61, a first profile 62, and a second profile 63. In particular configurations, first flange 64 and second flange 65 may extend from first profile 62 and second profile 63, respectively. In cross-section, picket carrier 60 may be open downwardly. Top-to-bottom apertures 66*a,b* may be defined within picket carrier 60, with span 61 residing across the top of picket carrier 60 between the apertures 66*a,b*.

Picket carrier 60 may be rigid in some configurations. In particular embodiments, top span 61, first profile 62, and second profile 63 may be rigid. In certain configurations, they may be integral. Still further, they may be symmetrical. In other embodiments, top span 61, first profile 62, second profile 63, first flange 64, and second flange 65 may be rigid; for particular applications they may be integral, and in other configurations they may be both rigid and integral. Still further, in any such configuration, they may be symmetrical.

Picket carrier 60 may be carried upon first shoulder 36 and second shoulder 37. In a particular embodiment, first flange 64 may reside upon and be carried by first shoulder 36 and second flange 65 may reside upon and be carried by second shoulder 37. In such a configuration, picket carrier 60 will be in contact with first wall 32 and second wall 33 of a rail 30, such as, for example, depicted in FIG. 4.

Figure 4:
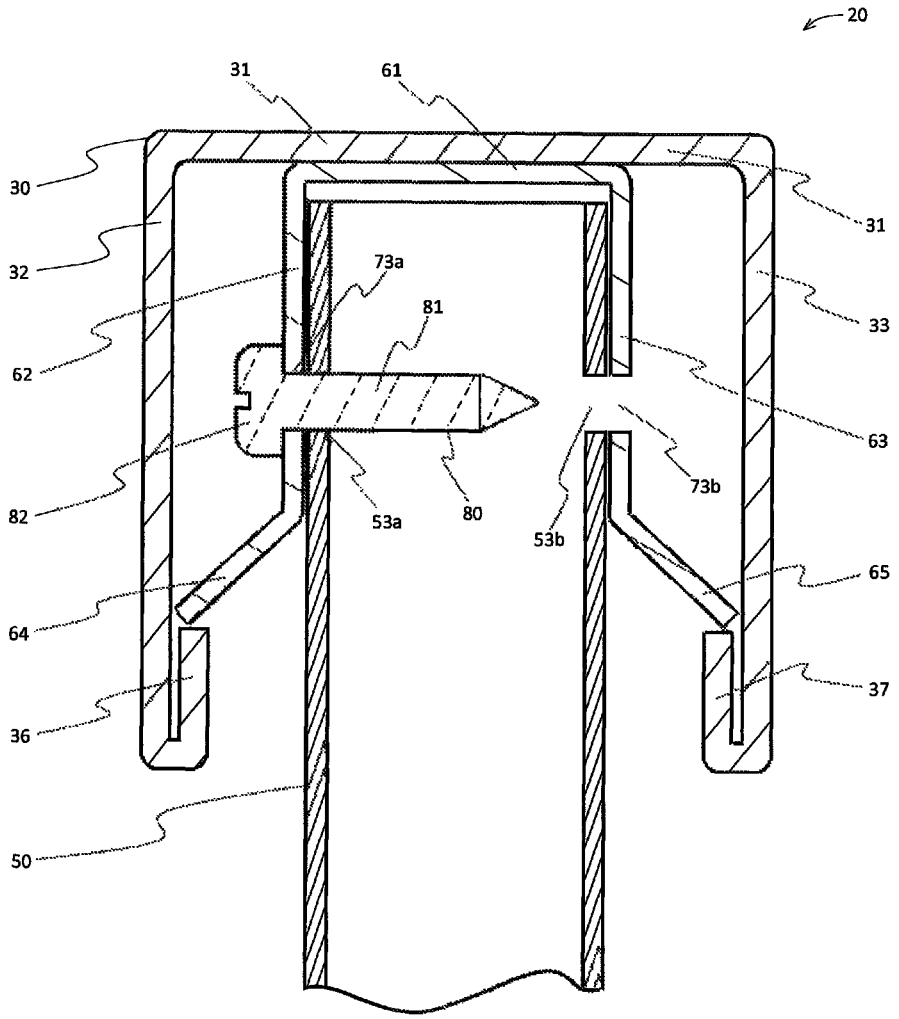
FIG. 4 is a sectional view, taken at line I-I in FIG. 1, of rackable fencing in accordance with certain aspects of the present invention.
Figure 9:
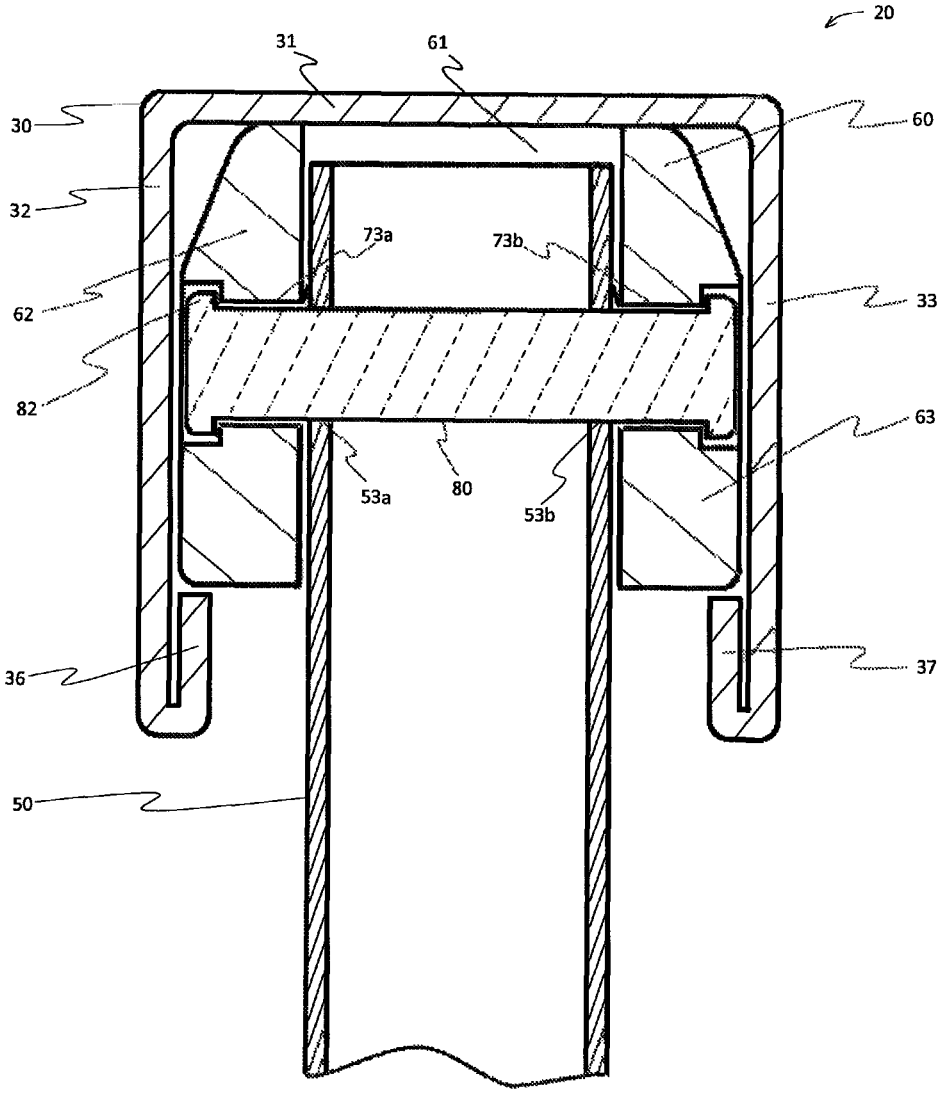
FIG. 9 is a sectional view, taken at line II-II in FIG. 1, of a rackable fence in accordance with certain aspects of the present invention.
Figure 11:
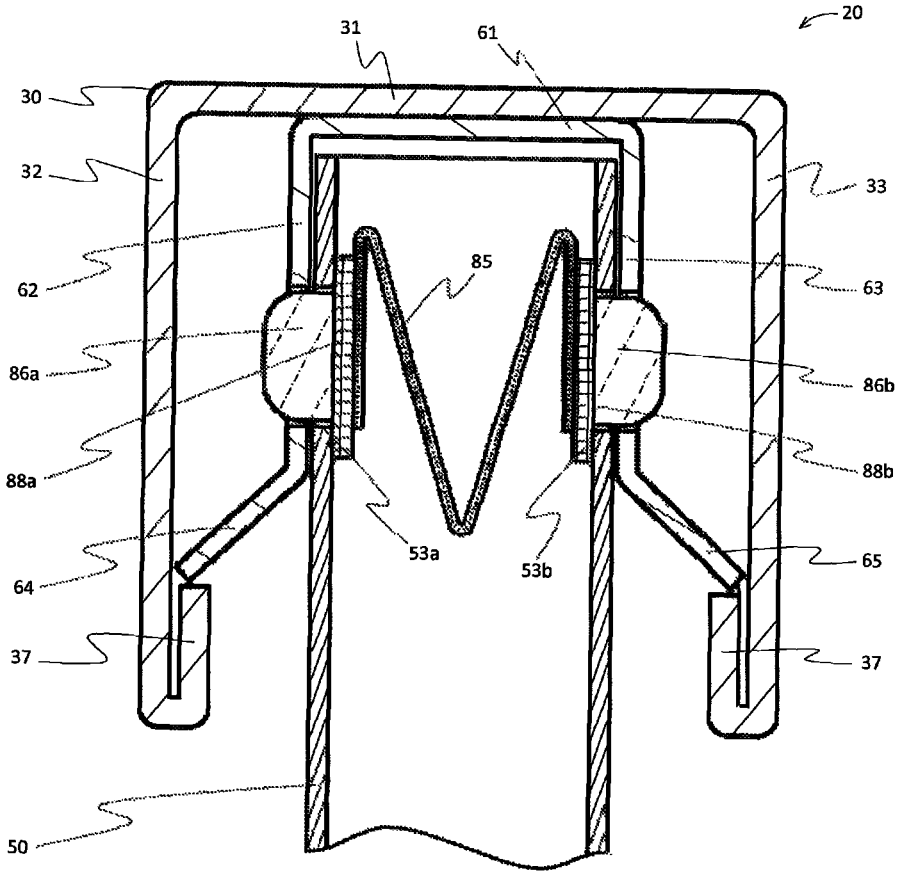
FIG. 11 is a sectional view, taken at line III-III in FIG. 1, of a rackable fence in accordance with certain aspects of the present invention.
Figure 14:
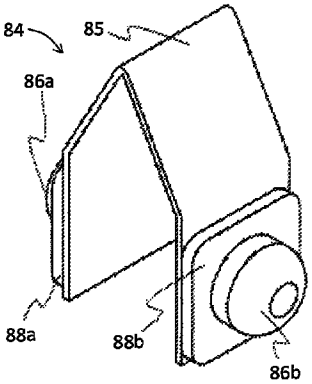
FIG. 14 is a perspective view of a keeper component of a rackable fence in accordance with certain aspects of the present invention.
Figure 13:
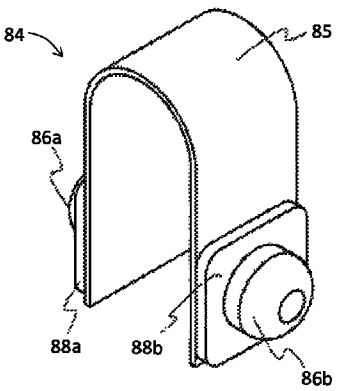
FIG. 13 is a perspective view of a keeper component of a rackable fence in accordance with certain aspects of the present invention.
Figure 12:
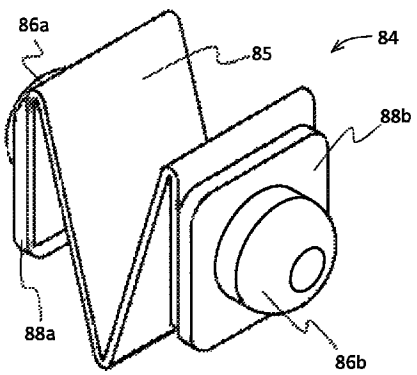
FIG. 12 is a perspective view of a keeper component of a rackable fence in accordance with certain aspects of the present invention.
Figure 18:
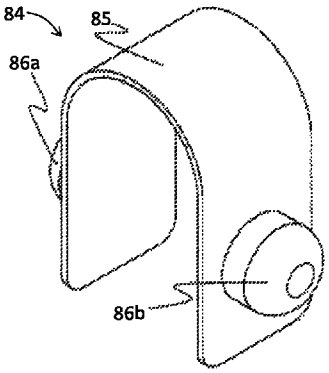
FIG. 18 is a perspective view of a keeper component of a rackable fence in accordance with certain aspects of the present invention.

Picket carrier 60 may define a cross-sectional width that is greater than the width between first and second shoulders 36, 37 of a rail 30, as depicted for example in FIGS. 4, 9, and 11.

Pickets 50*a,b* may be attached to the picket carrier 60 at apertures 66*a,b*, respectively. Such attachment may be by way of pivots 80. Pivots 80 may be disposed normal to the length of the rail 30.

A plurality of pickets 50, such as pickets 50*a,b*, are provided with fence 20. A picket 50 may include a first end 51 and a second end 52. In certain embodiments, first end 51 may include a notch 54. Notch 54 may comprise a slot 55 and a receiver 56, adapted for receipt through slot 55 and into receiver 56 of a pivot 80.

Pivot 80 may be provided by a screw, bolt, rivet, or pin. In a particular embodiment, pivot 80 may be provided by a spring-loaded keeper 84.

With such a configuration, a picket 50 may be attached to a picket carrier 60, such that it is pivotable toward a rail 30, as illustrated, for example, in FIG. 2, which shows a plurality of pickets, for example, pickets 50*a,b*, pivoted toward first rail 30 and pivoted toward second rail 40.

FIG. 1 illustrates an embodiment of fence 20. As depicted in FIG. 1, fence 20 is oriented for level installation. Rail 30 is carrying a picket carrier 60 (not shown) and rail 40 is likewise carrying a picket carrier 60 (not shown). Rail 30 is identical to rail 40 except that rail 40, as also described elsewhere in this disclosure, defines apertures through its header, for example first header 31. It will be noted from FIG. 1 that fence 20 includes picket carriers 60 and a plurality of pivots 80 that are concealed from view. As will be further understood from this disclosure, the opposite side of fence 20 shown in FIG. 1 may be identical to that side depicted in FIG. 1.

FIG. 2 shows the same fence 20 as depicted in FIG. 1, except that fencing 20 has been racked to an angle D suitable for installation upon an incline of the same angle; upon such an installation of racked fence 20 at such an incline, pickets 50*a,b* will be desirably oriented perpendicular to the horizon.

Figure 3:
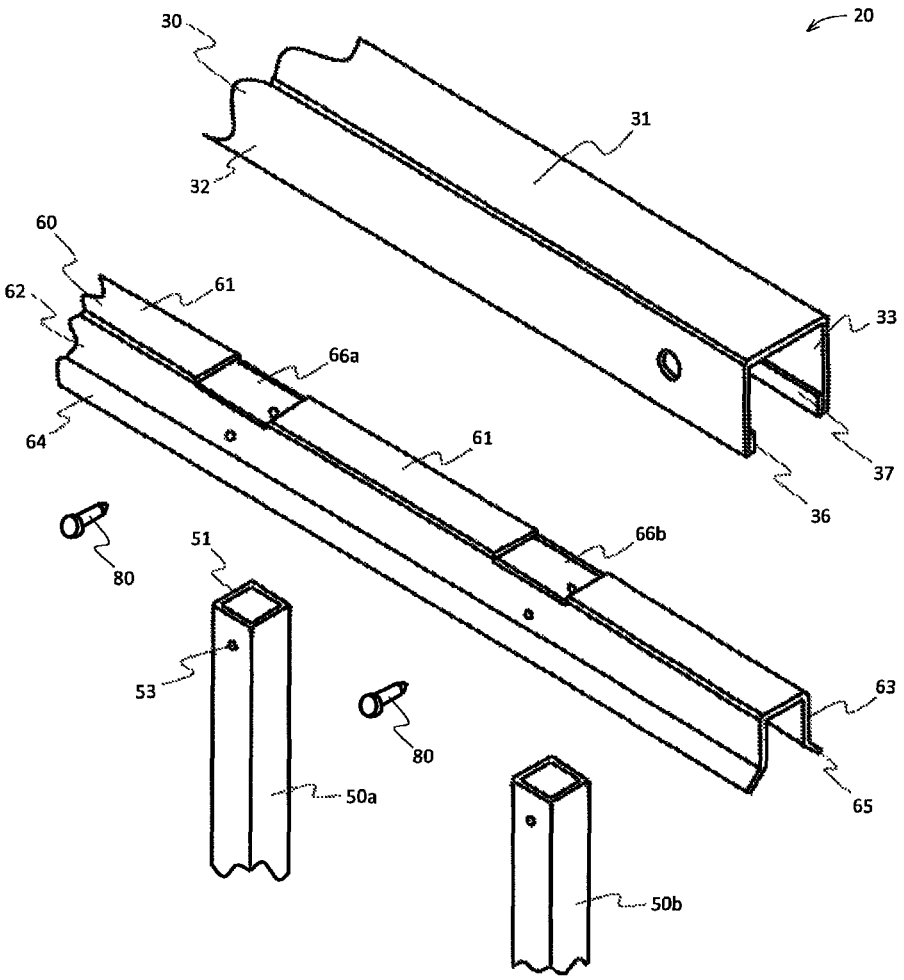
FIG. 3 is a partial, exploded perspective view of rackable fencing in accordance with certain aspects of the present invention.

FIG. 3 depicts components of a particular embodiment of fence 20. Specifically, a first rail 30 is provided. First rail 30 includes first header 31, first wall 32, and second wall 33. In the embodiment depicted in FIG. 3, first wall 32 carries first shoulder 36 and second wall 33 carries second shoulder 37. Likewise, a picket carrier 60 is provided. In the embodiment depicted, picket carrier 60 includes top span 61, first profile 62, and second profile 63. In the particular embodiment illustrated in FIG. 3, a first flange 64 is shown extending from first profile 62 and a second flange 65 is shown extending from second profile 63. Apertures 66*a,b* have been defined within top span 61 of picket carrier 60. Finally, pickets 50*a,b* are illustrated. A hole 53 is shown at first end 51 of picket 50*a*. Likewise, a pivot 80 is depicted. A method of assembly of the embodiment depicted in FIG. 3 would start with the step of positioning pickets 50*a,b* through apertures 66*a,b*, respectively. Next, pickets 50*a,b* would be attached to picket carrier 60 with pivots, for example, pivots 80. In a particular embodiment, self-tapping screws may be used for pivots 80. Finally, the assembly of picket carrier 60 and pickets 50*a,b* may then be inserted, vertically, as to the orientation of FIG. 3, into rail 30 top span 61 pushed between shoulders 36, 37; flanges 64, 65 would deflect inwardly upon such insertion until passing beyond shoulders 36, 37, which they may resiliently spring back toward their original orientations, thereby securing picket carrier 60, along with pickets 50*a,b* into rail 30. Optionally, picket carrier 60 could then be welded together with rail 30.

It will be appreciated that the same configuration of picket carrier 60 as illustrated with first rail 30 in FIG. 3 may also be used with a second rail 40 at the bottom of fence 20.

FIG. 4 is a cross-sectional view of an assembled fence 20 of the embodiment depicted in FIG. 3. Illustrated therein is a first rail 30, a picket carrier 60, and a picket 50. The embodiment of rail 30 shown in FIG. 4 displays an inverted U-shape cross-section. In the embodiment illustrated, the cross-section of rail 30 is symmetrical. First wall 32 extends downwardly from a first side of first header 31 and second wall 33 extends downwardly from the opposite side of first header 31. First shoulder 36 and second shoulder 37 are also illustrated, disposed at the bottom of the inverted U-shaped cross-section of rail 30, opposite one another and disposed toward one another.

The embodiment depicted in FIG. 4 illustrates picket carrier 60 residing within the channel defined by the cross-section of rail 30. More particularly, in the embodiment illustrated in FIG. 4, picket carrier 60 resides above shoulders 36, 37 and is carried by shoulders 36, 37. Picket carrier 60 is shown to include top span 61, first profile 62, second profile 64, first flange 64, and second flange 65. First flange 64 is carried upon first shoulder 36 and second flange 65 is carried upon second shoulder 37.

In the embodiment shown in FIG. 4, picket carrier 60 displays a cross-section that is open downwardly.

It will be further observed in FIG. 4 that span 61 of picket carrier 60 extends across the inverted U-shaped cross-section of rail 30. The particular embodiment illustrated in FIG. 4 of picket carrier 60 has a symmetrical cross-section.

In FIG. 4, the embodiment of picket carrier 60 is in contact with first wall 32 and second wall 33 of rail 30 in that picket carrier 60 is riding upon shoulders 36, 37. It will further be observed in FIG. 4 that the cross-sectional width of picket carrier 60 is greater than the width between first and second shoulders 36, 37.

Finally, FIG. 4 illustrates pivot 80 in place. In the embodiment shown, pivot 80 is a screw that includes shank 81 and head 82. Pivot 80 has been disposed through hole 53*a* in picket 50. Hole 53*b* is illustrated as open, a design allowing the flexibility of using a pivot 80 other than a screw, to extend through both first profile 62 and second profile 63 of picket carrier 60 in other embodiments.

Figure 5:
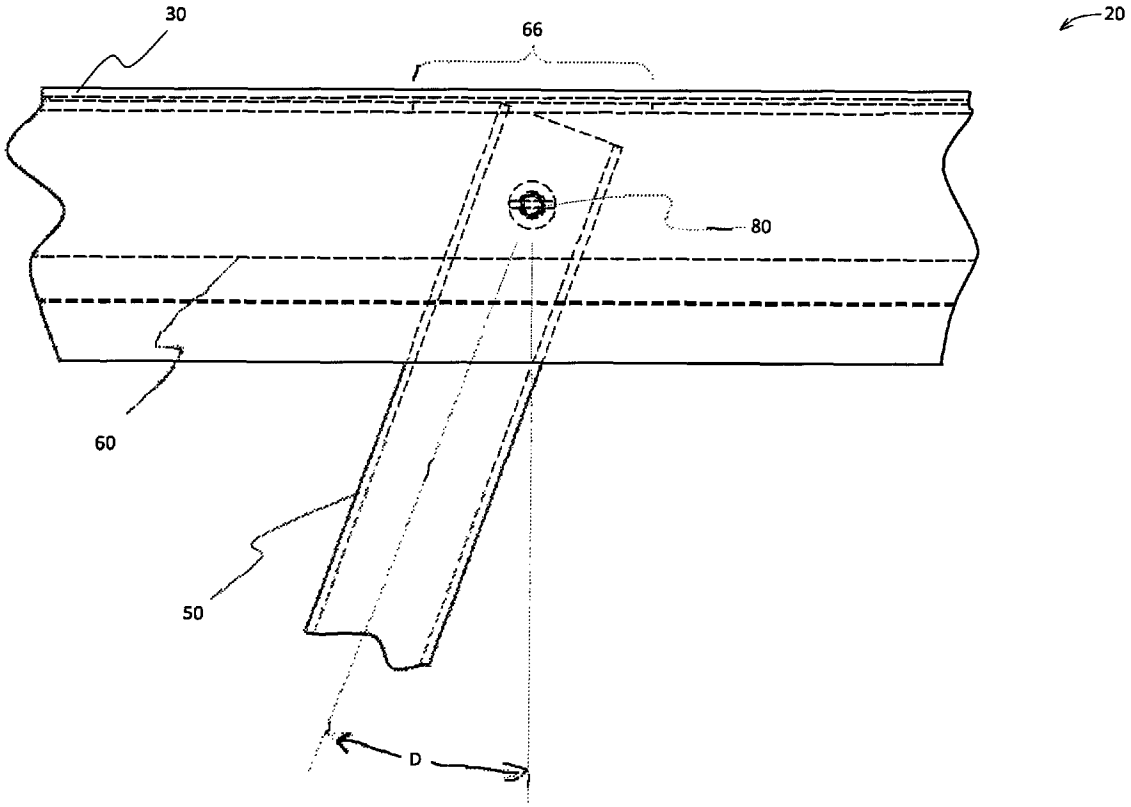
FIG. 5 is a partial side view, taken at A in FIG. 2, of a rackable fence in accordance with certain aspects of the present invention.

FIG. 5 shows the orientation of certain components of fence 20 when fence 20 is in a racked orientation. First rail 30 and picket 50 are depicted. Picket carrier 60 is shown in phantom, as is pivot 80, illustrating, among other aspects, that the completed assembly of fence 20 conceals from view picket carrier 60 and pivot 80.

Figure 6:
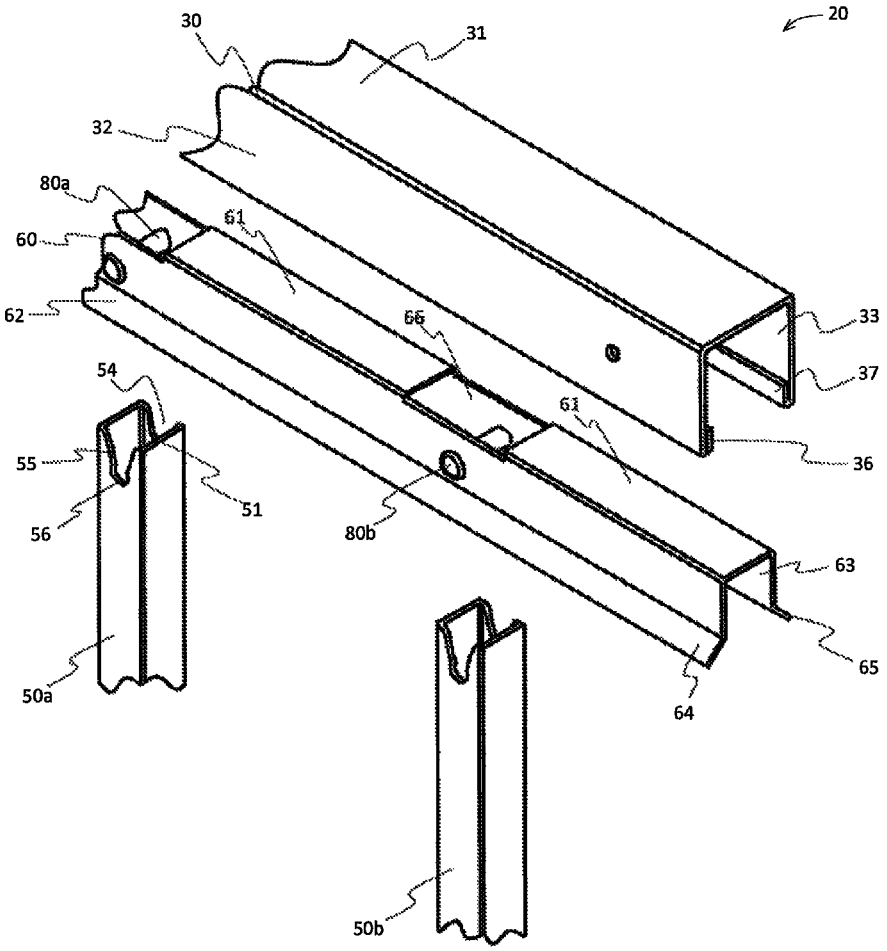
FIG. 6 is a partial, exploded perspective view of a rackable fence in accordance with certain aspects of the present invention.

FIG. 6 illustrates an embodiment of fence 20 similar to that of FIGS. 3, 4, and 5. However, in the embodiment depicted in FIG. 6, pivot 80 is provided by a pin. Also, pickets 50*a,b* have been configured each with a notch 54. Notch 54 comprises slot 55 and receiver 56. Notch 54 is configured to allow first end 51 of picket 50 to expand resiliently as a picket, for example picket 50*a* is pushed upon pivot 80*a*; first end 51 will expand about notch 54 until pivot 80*a* is received within and held to picket carrier 60 by the snap-fit engagement of notch 54 about pivot 80*a*. Assembly of the embodiment depicted in FIG. 6 may be accomplished in at least three different ways. First, picket carrier 60 may be pressed into rail 30, span 61 being pressed toward first header 31. Once picket carrier 60 is thereby interfitted within rail 30, pickets 50*a,b* may be snap-fitted upon pivots 80*a,b*, respectively. Second, the preceding steps may be reversed, with pickets 50*a,b*, first snap-fitted to pivots 80*a,b*, then picket carrier 60 pressed into rail 30 until flanges 64, 65 exceed shoulders 36, 37, respectively. Third, picket carrier 60 may be telescoped into rail 30, end-through-end, and pickets 50*a,b* then snap-fitted to pivots 80*a,b*.

Figure 7:
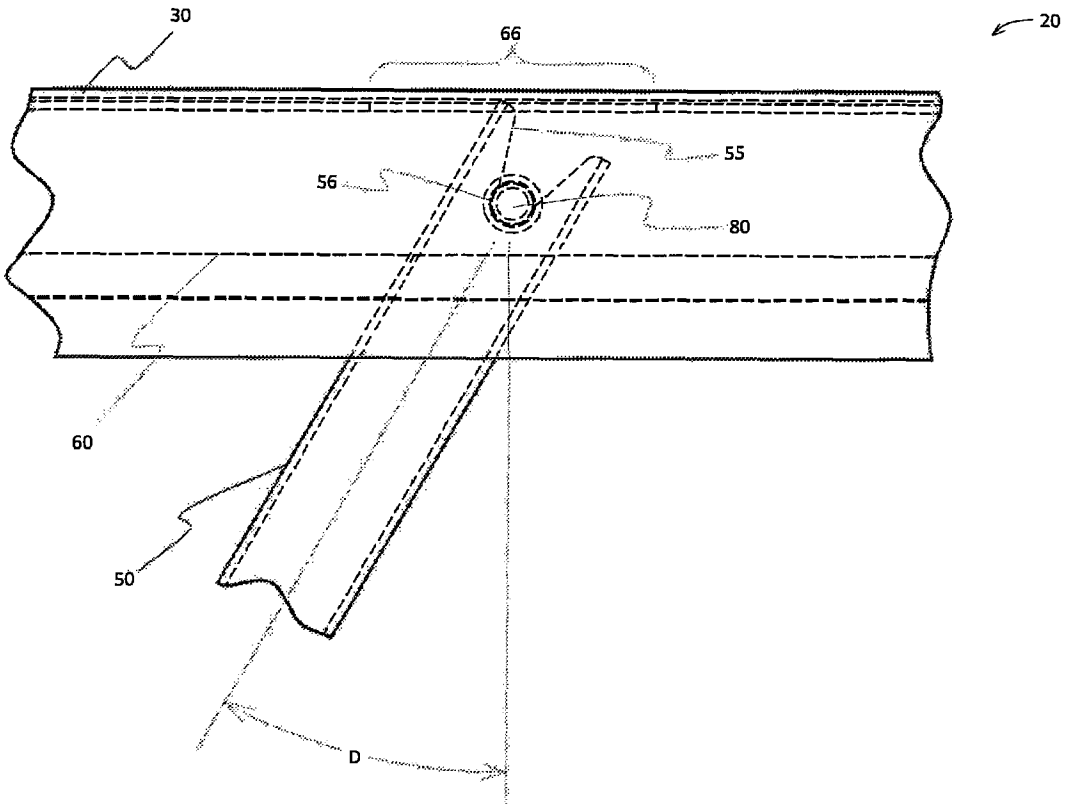
FIG. 7 is a partial side view, taken at B in FIG. 2, of a rackable fence in accordance with certain aspects of the present invention.

FIG. 7 illustrates the completed assembly of a fencing 20 of the embodiment also depicted in FIG. 6. Picket carrier 60 is shown in phantom, as is pivot 80, illustrating, among other aspects, that the completed assembly of fence 20 conceals from view picket carrier 60 and pivot 80.

Figure 8:
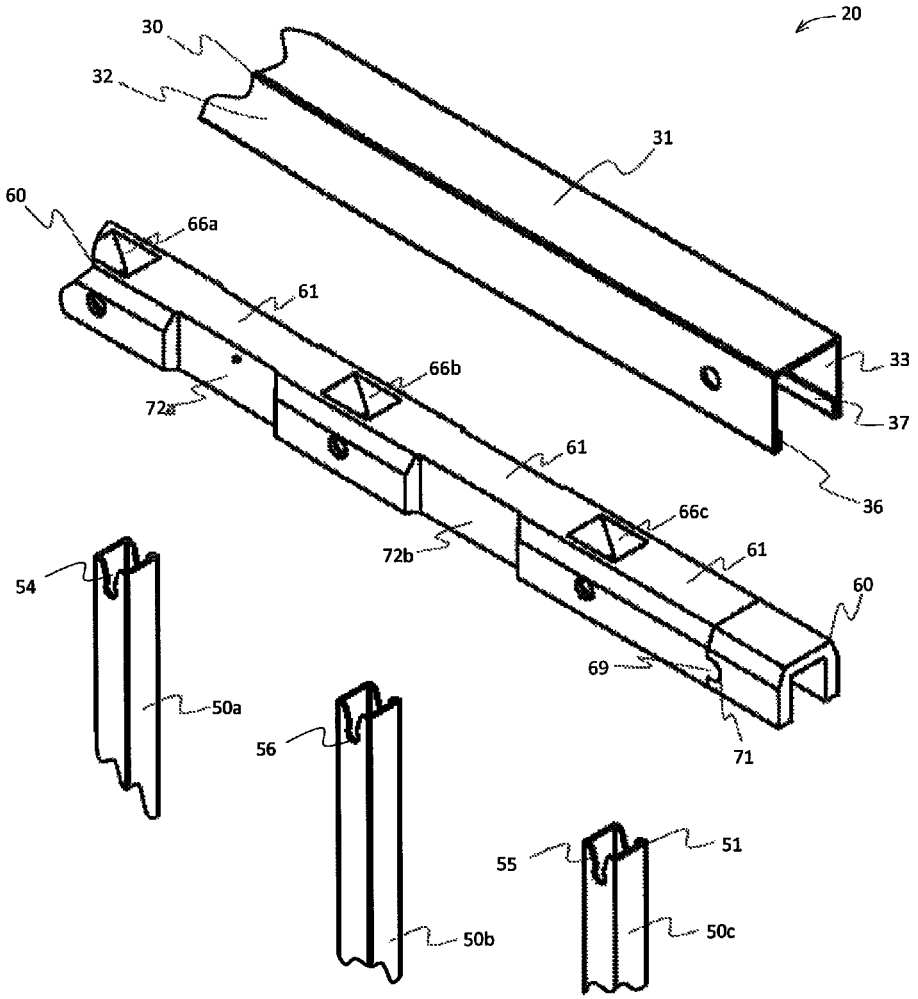
FIG. 8 is a partial, exploded perspective view of a rackable fence in accordance with certain aspects of the present invention.
Figure 10:
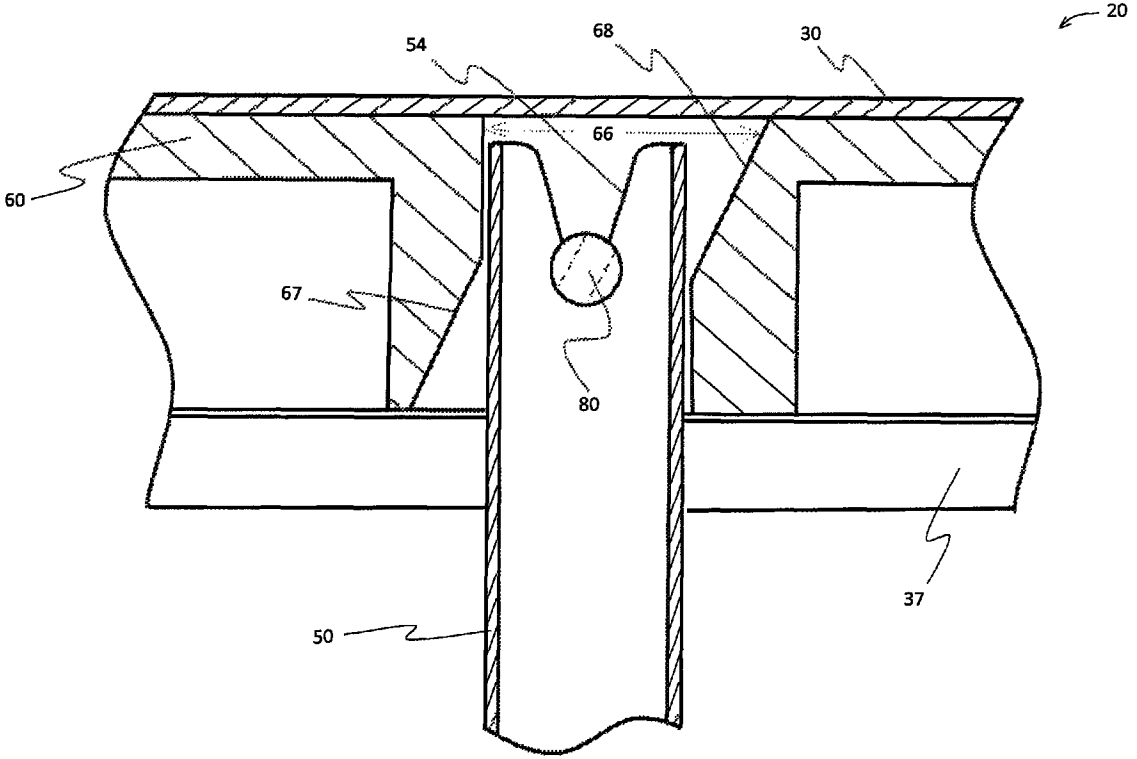
FIG. 10 is a partial side sectional view, taken at C in FIG. 1 of a rackable fence in accordance with certain aspects of the present invention.

FIGS. 8, 9, and 10 illustrate a yet further embodiment of fence 20. As depicted therein, a rail 30, as in the embodiments of FIGS. 1 through 7, is provided. Likewise, plural pickets 50 are provided; the embodiment illustrated in FIGS. 8 through 10 employ a configuration of pickets 50 as that of FIGS. 6 and 7, but the pickets of the embodiment of FIGS. 3, 4, and 5 could also be used. The embodiments of FIGS. 8 through 10, however, utilize a picket carrier 60 of injection molded plastic. Picket carrier 60 defines plural apertures, such as apertures 66*a, b, c*. The apertures 66 are provided with inclined first longitudinal side 67 and second longitudinal side 68, to allow fence 20 to rack. Additionally, picket carrier 60 is shown, in this embodiment, to include reliefs 72*a,b*. It will be further observed that the embodiment of picket carrier 60 illustrated in FIG. 8 further includes male connector 69 and female connector 71, by which multiple lengths of picket carrier 60 may be joined longitudinally.

As illustrated particularly in FIG. 9, use of a pin for pivot 80 can, in particular configurations, extend pivot 80 through both hole 53*a* and hole 53*b* in picket 50, along with aperture 73*a* and aperture 73*b* in picket carrier 60.

Figure 16:
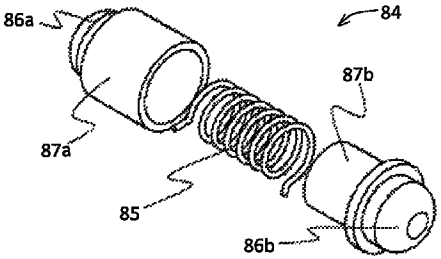
FIG. 16 is a perspective view of a keeper component of a rackable fence in accordance with certain aspects of the present invention.
Figure 15:
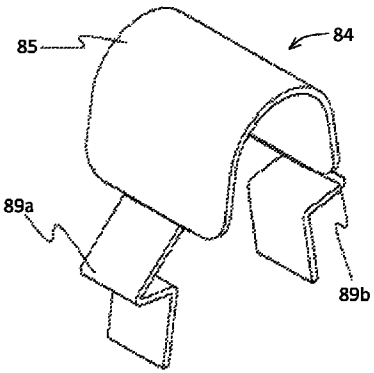
FIG. 15 is a perspective view of a keeper component of a rackable fence in accordance with certain aspects of the present invention.

FIG. 11 depicts a yet still further embodiment of fence 20. In the embodiment illustrated in FIG. 11, pivot 80 has been provided by way of spring-loaded keeper 84. Keeper 84 comprises spring 85 and ears 86*a,b* mounted on platforms 88*a,b*, respectively. Ears 86*a,b* are resiliently biased away from one another by spring 85; as such, they may be interposed through holes 53*a*, 53*b* in picket 50 as well as picket carrier 60 mounting holes 73*a,b*, respectively, thereby securing picket 50 to picket carrier 60. Various configurations of keeper 84 include those depicted in FIGS. 12 through 16 and FIG. 18. In the configuration of keeper 84 depicted in FIG. 15, elbows 89*a,b* are used for the same functionality as ears 86*a,b* in other configurations of keeper 84, elbows 89*a,b* extending through holes 53*a,b*, respectively, and mounting holes 73*a,b*, respectively, to secure a picket 50 to a picket carrier 60. In the configuration of keeper 84 depicted in FIG. 16, spring 85 may be carried within cups 87*a,b* for ease of assembly, cups 87*a,b* in turn carrying ears 86*a,b*.

Figure 17:
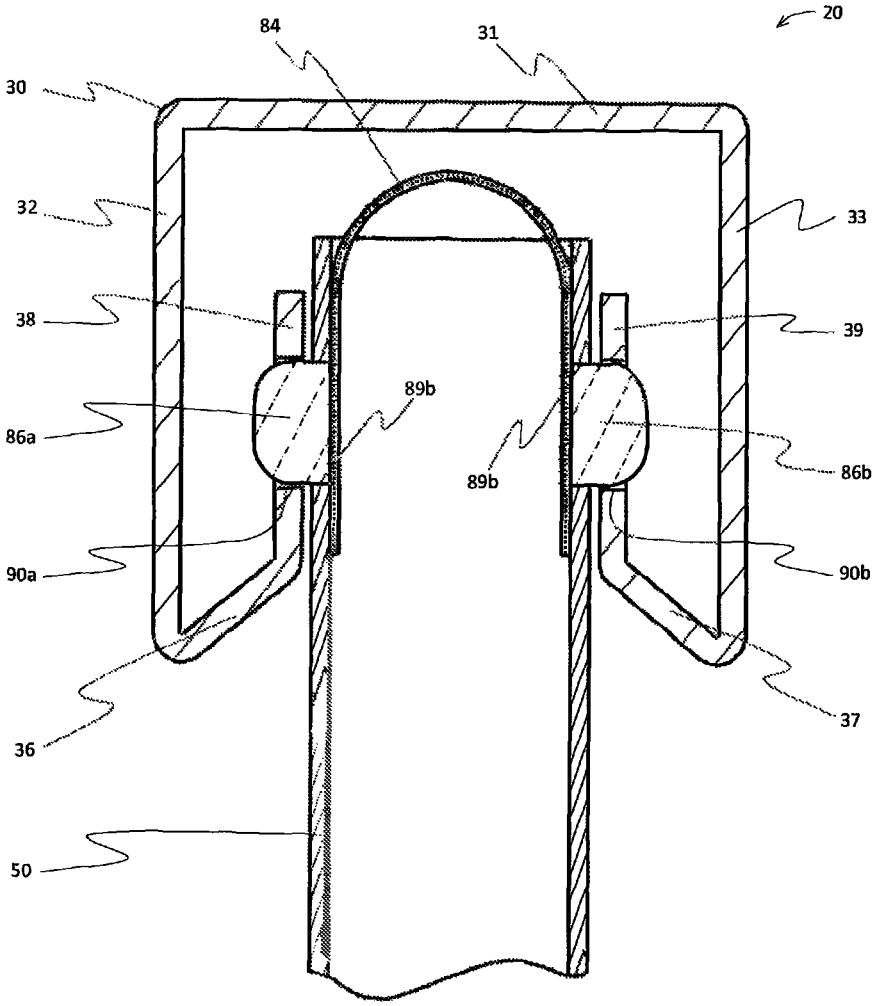
FIG. 17 is a sectional view, taken at line IV-IV in FIG. 1, of a rackable fence in accordance with certain aspects of the present invention.

FIG. 17 illustrates a yet still further embodiment of fence 20. In such embodiment, first shoulder 36 is extended to constitute first standard 38 and second shoulder 37 is extended to constitute second standard 39, standards 38, 39 thereby constituting a picket carrier 60. Use of a spring-loaded keeper 84, such as that further depicted in FIG. 19, allows, first, insertion of keeper 84 into picket 50, then insertion of picket 50 into picket carrier 60 of rail 30, securing picket 50 the completed assembly of fence 20.

The rackable fence 20, so configured, provides a clever and efficient design that achieves multiple fencing objectives. Its components, a minimal number of which are required, may be manufactured at a first location and shipped unassembled to a second location for assembly. The components may be painted, coated, or otherwise surface-treated at the manufacturing site yet later assembled at a second site without damage to finished surfaces from transport or from assembly, as they have no exposed or delicate features susceptible to damage in transit. The components may be densely packed into shipping containers, yet thereafter easily connected into finished fencing panels with efficient connectivity requiring the use only of simple and inexpensive tools. Once assembled and ready for sale to end users, the components complement the structural function of each other and the fence is sturdy, structurally sound, tight, and without loose parts, and connectors and structural details are concealed from view.

As disclosed herein, the present invention provides a rackable fence comprising components that have been optimized for shipping unassembled from a manufacturing location to a second, assembly location. While preferred embodiments of the invention have been shown and described, modifications and variations may be made without departing from the spirit and scope of the present invention. Therefore, it should be understood that various embodiments may be interchanged, both in whole or in part. Furthermore, those with skill in this technology will appreciate that the foregoing description is by way of example only and is not intended to be a limitation of the invention as further described in the appended claims.

The invention claimed is:

1. A rackable fence, comprising:

a rail, the rail defining a rigid inverted U-shaped cross-section and a longitudinal axis;

a picket carrier, the picket carrier carried within and extending across the inverted U-shaped cross-section wherein the picket carrier further includes a first end and a second end, the first end having a male connector for connection to another picket carrier;

a pivot attachment; and, a picket, the picket including a first end and a second end, the first end defining a notch, the pivot attachment residing within the notch, the picket pivotally engaged with the picket carrier and pivotable toward the rail.

2. A rackable fence, comprising:

a rail, the rail defining a rigid inverted U-shaped cross-section and a longitudinal axis;

a picket carrier, the picket carrier carried within and extending across the inverted U-shaped cross-section wherein the picket carrier further includes a first end and a second end, the first end having a male connector for connection to another picket carrier and wherein the second end of the picket carrier has a female connector for connection to another picket carrier;

a pivot attachment; and, a picket, the picket including a first end and a second end, the first end defining a notch, the pivot attachment residing within the notch, the picket pivotally engaged with the picket carrier and pivotable toward the rail.

3. A rackable fence, comprising:

a rail, the rail defining a rigid inverted U-shaped cross-section and a longitudinal axis;

a plurality of pickets, the pickets each including a first end and a second end, the pickets each pivotable toward the rail; and a picket carrier, the picket carrier including a top span residing within and extending across the inverted U-shaped cross-section, the top span of the picket carrier defining a plurality of apertures, each aperture having an inclined first longitudinal side and an inclined second longitudinal side to allow the pickets to pivot;

wherein the pickets are pivotally attached to the picket carrier.

4. The rackable fence of claim 3, wherein the picket carrier further includes a first end and a second end, the first end having a male connector for connection to another picket carrier.

5. The rackable fence of claim 4, wherein the second end of the picket carrier has a female connector for connection to another picket carrier.

6. The rackable fence of claim 3, wherein the picket carrier further includes first and second sides extending downwardly from the top span, the first and second sides having a plurality of reliefs formed therein.

7. The rackable fence of claim 3, wherein the pickets are pivotally attached to the picket carrier by a plurality of pivot attachments, wherein the pivot attachments are one of a screw, a bolt, a pin, a rivet, and a spring-loaded keeper.

8. A rackable fence, comprising:

a rail, the rail defining a rigid inverted U-shaped cross-section and a longitudinal axis;

a picket carrier, the picket carrier residing within and extending across the inverted U-shaped cross-section;

a plurality of pickets, the pickets pivotable toward the rail; and, a plurality of spring-loaded pivot attachments disposed within the U-shaped cross-section for pivotally attaching the pickets to the picket carrier wherein the spring-loaded pivot attachments each comprise a first ear, a second ear, and a spring disposed therebetween, the first and second ears are resiliently biased away from each other by the spring, and wherein the spring-loaded pivot attachments each further comprise a first platform and a second platform, the first ear is disposed on the first platform, the second ear is disposed on the second platform, and the spring is secured between the first and second platforms.

9. A rackable fence, comprising:

a rail, the rail defining a rigid inverted U-shaped cross-section and a longitudinal axis;

a picket carrier, the picket carrier residing within and extending across the inverted U-shaped cross-section;

a plurality of pickets, the pickets pivotable toward the rail; and, a plurality of spring-loaded pivot attachments disposed within the U-shaped cross-section for pivotally attaching the pickets to the picket carrier wherein the spring-loaded pivot attachments each comprise a first ear, a second ear, and a spring disposed therebetween, the first and second ears are resiliently biased away from each other by the spring, and wherein the spring-loaded pivot attachments each further comprise a first cup and a second cup, the first ear is carried by the first cup, the second ear is carried by the second cup, and the spring is secured between the first and second cups.

10. A rackable fence, comprising:

a rail, the rail defining a rigid inverted U-shaped cross-section and a longitudinal axis;

a picket carrier, the picket carrier residing within and extending across the inverted U-shaped cross-section;

a plurality of pickets, the pickets pivotable toward the rail; and, a plurality of spring-loaded pivot attachments disposed within the U-shaped cross-section for pivotally attaching the pickets to the picket carrier wherein the spring-loaded pivot attachments each comprise a first ear, a second ear, and a spring disposed therebetween, the first and second ears are resiliently biased away from each other by the spring, and wherein the spring-loaded pivot attachments each further comprise a first cup and a second cup, the first ear is carried by the first cup, the second ear is carried by the second cup, and the spring is secured between the first and second cups and, wherein the spring is a coiled wire.

* * * * *